United States Patent [19]

Kessler

[11] 4,315,661

[45] Feb. 16, 1982

[54] DRAWER SLIDE

[76] Inventor: Seymour A. Kessler, 2851 NE. 183rd St., North Miami Beach, Fla. 33160

[21] Appl. No.: 102,965

[22] Filed: Dec. 12, 1979

[51] Int. Cl.[3] ..... A47B 88/04; F16C 21/00

[52] U.S. Cl. ..... 312/330 R; 312/337; 312/340; 312/341 R; 308/3.8

[58] Field of Search ..... 312/341 R, 339, 331, 312/330, 337, 340, 341 NR; 308/3.8

[56] References Cited

U.S. PATENT DOCUMENTS

| | | | |
|---|---|---|---|
| 2,200,319 | 5/1940 | Balkind | 312/341 R |
| 2,325,896 | 8/1943 | Waller | 308/3.8 |
| 2,822,232 | 2/1958 | Lhota | 312/341 R |
| 2,981,584 | 4/1961 | Friend | 312/337 |
| 3,099,501 | 7/1963 | Hillson et al. | 312/341 R |
| 3,185,530 | 5/1965 | Reiss, Sr. et al. | 312/341 NR |
| 3,744,869 | 7/1973 | Anderson et al. | 312/340 |
| 3,912,341 | 10/1975 | Stein | 312/341 R |
| 4,121,876 | 10/1978 | Ratti | 312/330 R |

FOREIGN PATENT DOCUMENTS

| | | | |
|---|---|---|---|
| 285732 | 2/1965 | Netherlands | 312/341 R |

*Primary Examiner*—Victor N. Sakran

*Attorney, Agent, or Firm*—Malin & Haley

[57] ABSTRACT

An improved mating drawer slide system including two pair of longitudinal channel members for each drawer. The first pair of channel members includes one slide connectable to the cabinet and the mating second slide connectable to one side of a movable drawer. The other pair of channel members is a mirror image of the first pair. Each improved drawer slide channel member includes a main portion, an upper flange, anti-friction wheel, and a hub connected to the anti-friction wheel and the main portion. The main portion includes an upper and lower outwardly projecting wheel guide portion that engages the side of the anti-friction wheel on the mating slide. The main portion is provided with connector openings between the guide portions. The hub is connected to the main portion between the guide openings. The guide portions prevent engagement of the anti-friction wheel and the heads of connectors placed in the connector openings.

3 Claims, 7 Drawing Figures

DRAWER SLIDE

BACKGROUND OF THE INVENTION

The present invention is a new and improved drawer slide system that includes a non-complex slide with guide portions projecting outward in the same direction as the upper flange and with the hub of the anti-friction wheel connected to the main portion of the slide between the guide portions.

In recent times, conventional drawer slides have included anti-frictional members positioned above the main longitudinal member. Such complex designs are expensive to manufacture. Progressive drawer slide systems such as disclosed in U.S. Pat. No. 3,912,341 are also costly to manufacture. Such designs have limited use in the metal cabinets arts because of tolerance requirements. Limited play in a lateral direction is not a problem with metal cabinets but is in wooden cabinets because of their natural tendency to warp, swell, and shrink. The present invention relates to a non-complex design.

SUMMARY OF THE INVENTION

The drawer slide system includes a pair of channel members each of which includes a pair of slides that take the form of two longitudinal slides, one of which is attached at appropriate position on the cabinet wall and another of which is attached at an appropriate mating position on the drawer itself. A second pair having slide in the form of mirror images of the other slides, is placed on the opposite side of the drawer. Each slide in each pair of channel members is provided with an anti-friction wheel positioned between the two channel members to provide relative ease of movement of the drawer in a longitudinal direction. The wheels engage a flange on the slides.

This drawer slide system operates smoothly and effectively in wooden as well as metal cabinets, not withstanding variations in workmanship and assembly procedures. This new and improved drawer slide includes built-in compensation features which allow for slight errors in workmanship and assemblage in manufacturing cabinets. Each improved drawer slide channel member includes a main portion, an upper flange, anti-friction wheel, and a hub connected to the anti-friction wheel and the main portion. The main portion includes an upper and lower outwardly projecting wheel guide portion that engages the side of the anti-friction wheel on the mating slide. The main portion is provided with connector openings between the guide openings. The guide portions prevent engagements of the anti-friction wheel and the heads of connectors placed in the connector openings.

Accordingly, it is an object of the present invention to provide non-complex drawer slide system.

It is an object of the present invention to provide a drawer slide system equipped with a means for reducing lateral play of the wheels during operation of the drawer.

It is a further object of the present invention to provide a drawer slide of the type described which has the ability to operate effectively notwithstanding irregularities in cabinet workmanship and cabinet assembly techniques.

It is a further object of the present invention to provide a drawer slide system of the type described which consists of two longitudinally extended slides with anti-friction wheels positioned between the two channel members with each wheel connected between channel wheel guide portions or means.

A further object of the present invention is to provide a drawer slide of the type described which can be effectively used in both wood and metal cabinets.

It is an additional object of the present invention to provide a drawer slide of the type described which includes guide portions that are raised from the main portion of the slide to provide protection against engagement of the wheels and misaligned screw fasteners or the like.

In accordance with these and other objects which will be apparent hereinafter, the instant invention will now be described with particular reference to the accompanying drawings.

DESCRIPTION OF THE PREFERRED EMBODIMENT

Figure 5:
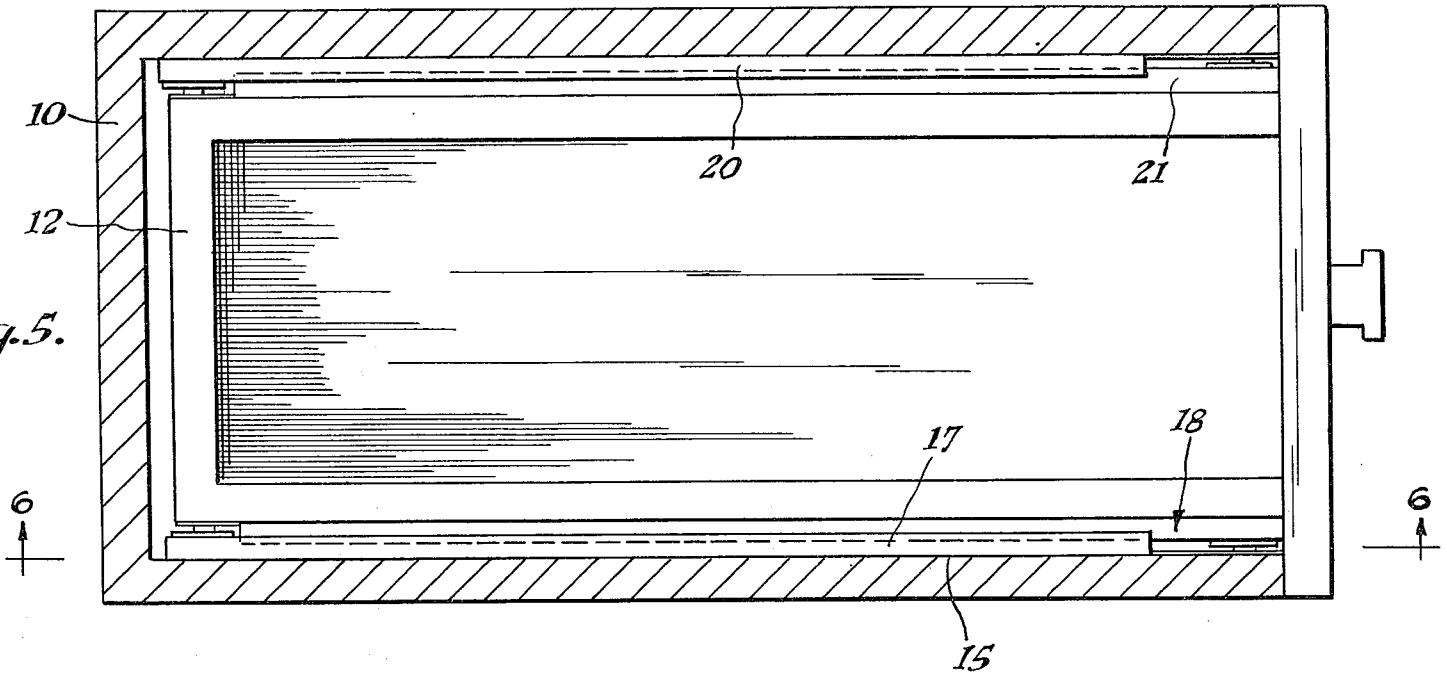
FIG. 5 is a horizontal sectional view through a cabinet illustrating a drawer assembly incorporating the improved mating drawer slide system, that is, the two pair of drawer slides as shown in FIGS. 1 and 3.
Figure 6:
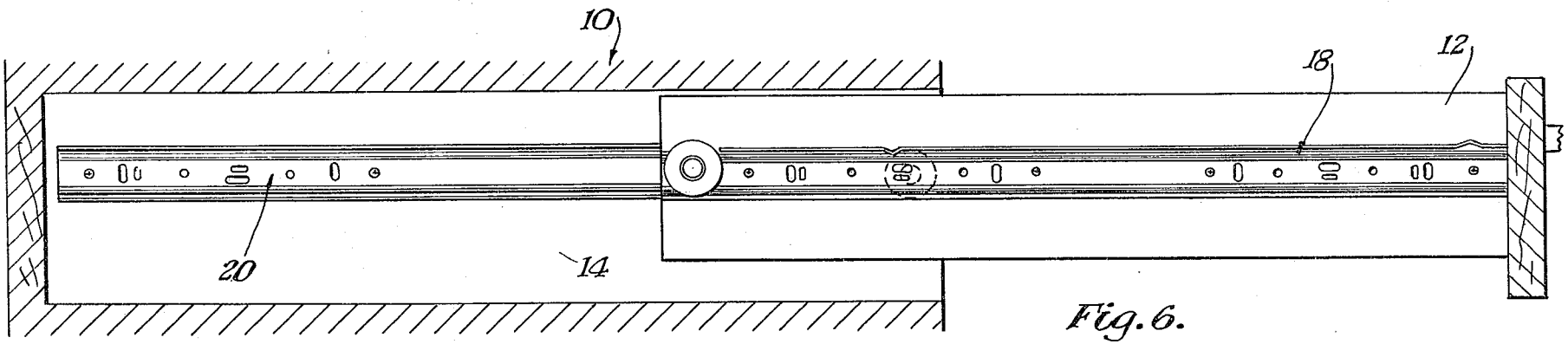
FIG. 6 is an elevational sectional view of FIG. 5 taken along lines 6—6 and looking in the direction of the arrows with the drawer in a partially open position to illustrate both slides shown in FIGS. 1 and 3 in use.

Referring now to the drawings, FIGS. 5 and 6, there is shown a cut away portion of cabinet 10 within which is mounted a drawer 12, the drawer is suspended between two pair of slide assemblies or longitudinal channel members 17, 18, 20 and 21 in accordance with the present invention. Each pair of channel members is comprised of two longitudianally extended mating slides shown as 17, 18 and 20, 21. One slide 17 is secured to wall 15 of the stationary cabinet member 10. The second slide 18 is secured to the left side of drawer 12. The second pair of channel members have a slide 20 connected to wall 14 as shown in FIG. 6 and a slide 21 connected to the right side of drawer 12. Each pair of longitudinally extended slides are connected by anti-friction wheels which allow longitudinal movement of the drawer 12.

Figure 1:
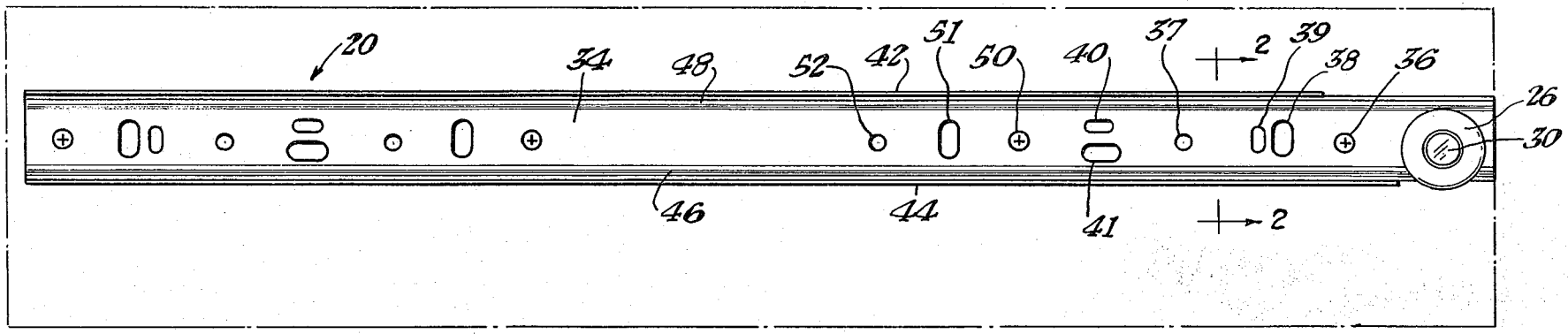
FIG. 1 is a side view of the mating slide on one side of the cabinet, the right side.
Figure 4:
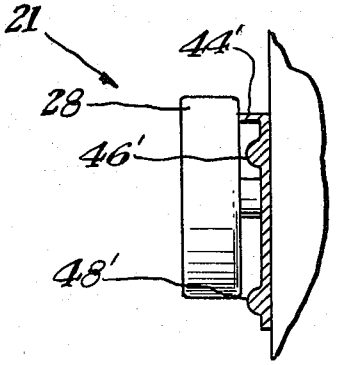
FIG. 4 is a rear end view of the mirror image of the slide shown in FIG. 3, this slide mates with the slide shown in FIGS. 1 and 2.
Figure 2:
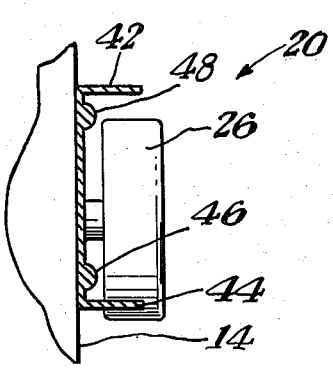
FIG. 2 is a rear end view of the slide shown in FIG. 1, the mirror image slide is connected to the other side of the cabinet.

Referring now to FIGS. 1 and 2, the slide 20 connected to cabinet wall 14 includes three parts, a longitudinal slide 20, a wheel 26, and a hub 30. The longitudinal slide 20 shown in FIGS. 5 and 6 is connected to a cabinet wall and the mating slide 21 shown in FIGS. 4 and 5. Slide 21 is connected to the right side of a sliding drawer 12.

Figure 3:
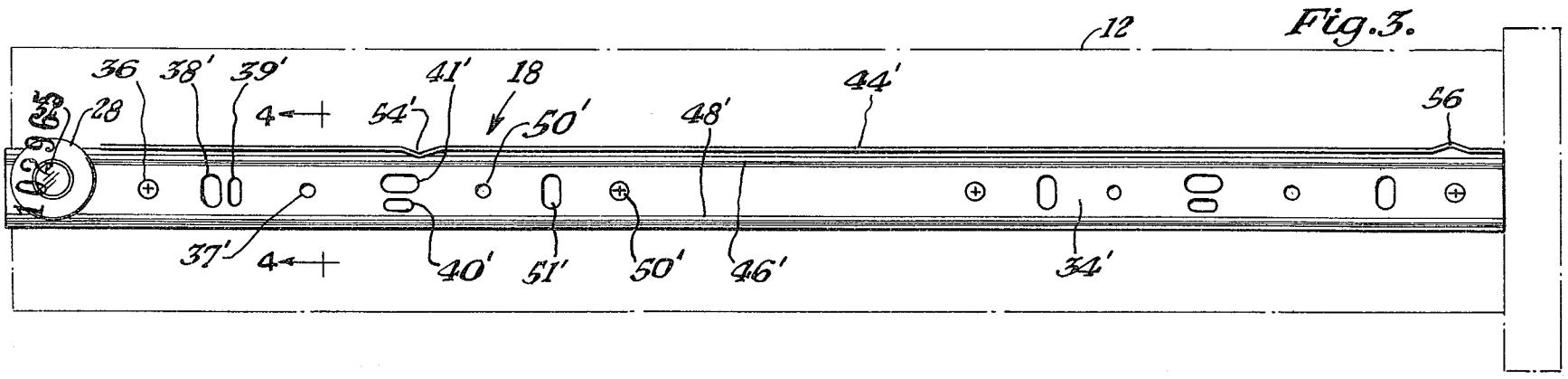
FIG. 3 is a side view of one slide connected to the left side of the drawer and mates with the mirror image of the slide shown in FIG. 1.

Referring now to FIG. 3, the slide 18 is connected to the left side of drawer 12 and includes three parts, a longitudinal slide 18, a wheel 28, and a hub 32. The longitudinal slide 18 shown in FIGS. 5 and 6 is connected to the drawer 12 and the mating slide 17 is shown in FIG. 5. Slide 17 is connected to the left side of the cabinet.

It should be noted that the left cabinet slide 17 is a mirror image of the right cabinet slide 20 as shown in FIG. 5. Left drawer slide 18 is a mirror image of the right drawer slide 21 as shown in FIG. 5.

The slides as shown in FIGS. 1, 2, 3 and 4 includes main portions or main body portions 34 or 34', that is generally flat having fastening openings 36, 36', 37, 37', 38,38', 39, 39', 40, 40', 41, 41', 50, 50', 51, 51', and 52, 52' respectively. Some of the openings are enlarged to allow adjustment before final tightening of screws, staplers or other connectors used to secure the slide to the cabinet or drawer. The openings allow the use of unskilled labor when installing drawers so that the drawers may move easily and accurately in wooden or metal cabinets before final adjustment. The main portions 34 also includes flange 42. The main portions 34 and 34' include lower flange 44 and upper flange 44' respectively. The anti-friction wheel 26 or 28 may be made of nylon. The hubs 30 or 32 are connected to the main portion between guide portions 46, 48 and 46'–48' respectively. The hubs outwardly projecting wheel guide portions or means 46, 46', 48 and 48' are positioned generally parallel to the flanges. The guide portions or means 46, 46', 48 and 48' provide for a reduced lateral play of the anti-friction wheels during operation of the drawer. The guide portions engage the side of the anti-friction wheel on the mating slide. The guide portions or means also prevent engagement between the heads of connectors and the anti-friction wheel, even when the screw connectors are placed in the cabinet or drawer at an angle other than perpendicular to the surface of the main portion.

The slide 18 has an indentation 54' which tends to prevent the drawer from moving all the way out when the drawer is opened. The identation 56 holds the drawer in a closed position by engagement with an anti-friction wheel on the mating slide. Anti-friction wheels are mounted on the slide and project outward between the two mating slide members.

The drawer slide has only an upper flange 44' upon which the wheel of the mating cabinet slide rolls. The drawer wheel rides on flange 42 of the mating cabinet slide. It is these flanges which prevents extensive up and down movement during operation of the drawer. Wheels 26 and 28 in each mating pair engages the guide portions which prevents excessive lateral movement.

Slide 20 in FIG. 1 has a upper lip portion or upper flange portion removed at the forward end on the drawer. This opening allows drawer to be placed in the slide assembly in the cabinet or to remove the drawer from the cabinet. Other portions of flange 44 and 44' are removed to provide space for the wheels.

Figure 7:
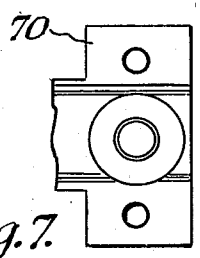
FIG. 7 is a partial view of another embodiment of the front end of FIG. 1.

FIG. 7 shows another embodiment of the front end of the slide 20 in FIG. 1. A connecting plate portion or tab 70 may extend from the slide 70 as shown. The tab 70 may have an upper or lower tab portion or both. The tab may be formed from the flange material that is left in a flat position. The tabs may include connector holes.

It should be noted that the slide and wheel arrangement is think and therefore bends itself to use on a moveable shelf in a desk.

From the foregoing, it will be appreciated that there is provided, in accordance with the present invention, an improved drawer slide assembly having particular advantages for use in supporting drawers or the like in installations where substantial tolerance variations may be encountered. The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A slide assembly comprising:

two mating members including a first member connectable to a moveable furniture item and a second member connectable to an adjacent non movable furniture item supporting the movable furniture item by said slide assembly and said second member directly interconnectable and solely connected to said first member, each of said members including, a main portion positioned vertically and having an upper edge and lower edge, and an upper flange portion projecting outwardly toward the other mating member, said main portion including outwardly projecting wheel guide means, one rotatable wheel positioned vertically, a hub connected to said main portion, said wheel moveably connected to said hub with a circumference extending beyond the edge of said main portion, said wheel guide means for limiting the side movement of the wheels by contacting the sides of said wheel, said wheel guide means sized and positioned to engage the side of the wheels, whereby said wheel is held in position between said first member and said second member.

2. A slide in accordance with claim 1, wherein:

said wheel guide means sized and positioned to prevent engagement between the heads of connectors and the sides of said wheels, said main portion having a plurality of connector openings.

3. A slide in accordance with claim 1, wherein:

said wheel sized and positioned to engage said upper flange portion of said other mating member, said upper flange portion provides a guide and support function in relation to said wheel on said other mating member.

* * * * *